US006419166B1

(12) United States Patent
Brzezinski et al.

(10) Patent No.: US 6,419,166 B1
(45) Date of Patent: Jul. 16, 2002

(54) DISPENSER TO LIQUID STREAM

(76) Inventors: Stan F. Brzezinski; Elizabeth Brzezinski, both of 2961 Avenida Simi, Simi Valley, CA (US) 93063

( * ) Notice: Subject to any disclaimer, the term of this patent is extended or adjusted under 35 U.S.C. 154(b) by 0 days.

(21) Appl. No.: 09/561,095

(22) Filed: Apr. 28, 2000

(51) Int. Cl.[7] ..... A62C 5/02; B05B 7/26; B65D 83/00

(52) U.S. Cl. ..... 239/310; 239/314; 239/316; 239/317; 222/395

(58) Field of Search ..... 239/310, 302, 239/314, 316, 317, 318, 309, 374, 378, 10; 222/395, 80–83, 83.5, 145, 325, 541.1

(56) References Cited

U.S. PATENT DOCUMENTS 4,189,100 A * 2/1980 Karp ..... 239/310
4,294,280 A * 10/1981 Tom ..... 137/268
4,340,078 A * 7/1982 Pasley ..... 137/205.5
4,881,568 A * 11/1989 Ho ..... 137/268
4,901,890 A * 2/1990 Mivelaz ..... 222/395
5,135,173 A * 8/1992 Cho ..... 239/305
5,413,280 A * 5/1995 Taylor ..... 239/10
5,743,960 A * 4/1998 Tisone ..... 118/683

* cited by examiner

*Primary Examiner*—William C. Doerrler
*Assistant Examiner*—Davis Hwu
(74) *Attorney, Agent, or Firm*—Colin P. Abrahams

(57) ABSTRACT

A dispenser for introducing additive into a liquid stream comprises a housing unit having a flow-through passage forming a pathway for the liquid stream. A seating on the housing is provided for receiving a receptacle. The seating includes a reservoir for holding the additive. A conduit extends between the seating and the flow-through passage through which the additive can flow. A valve is also provided for selectively controlling the flow of the additive in the conduit.

26 Claims, 6 Drawing Sheets

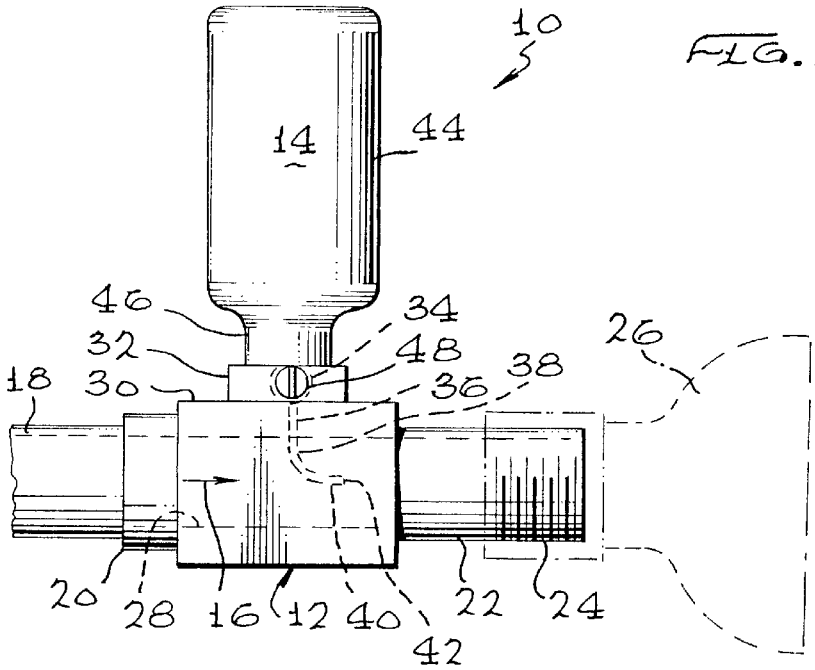
FIG. 1
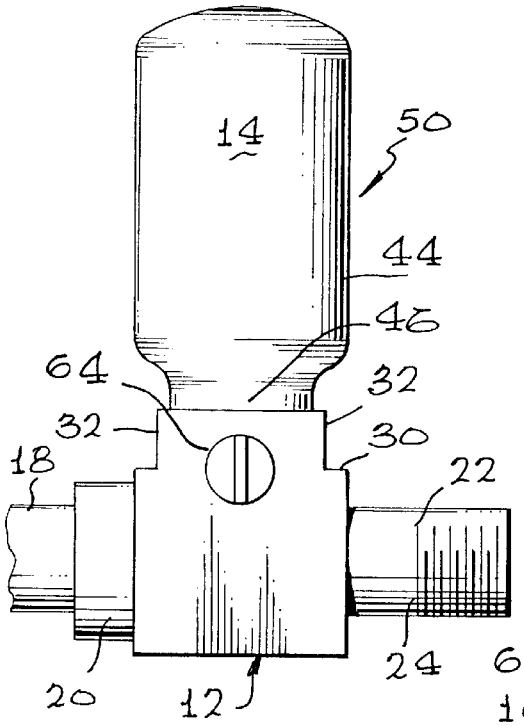
FIG. 2
FIG. 3
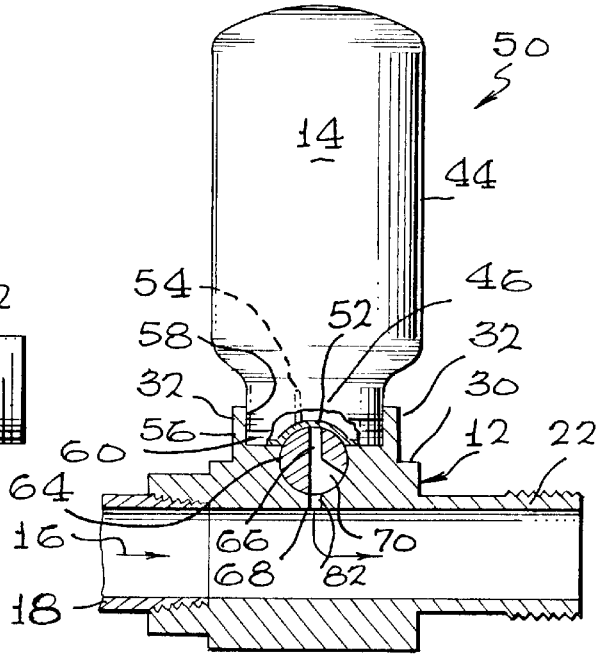

FIG. 4
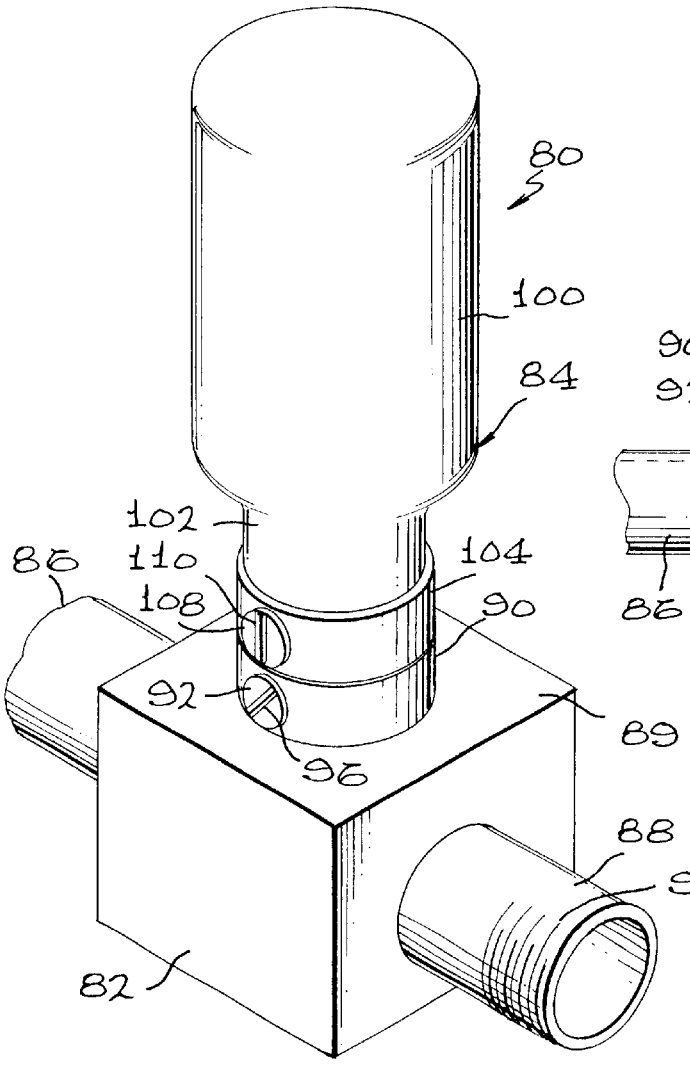
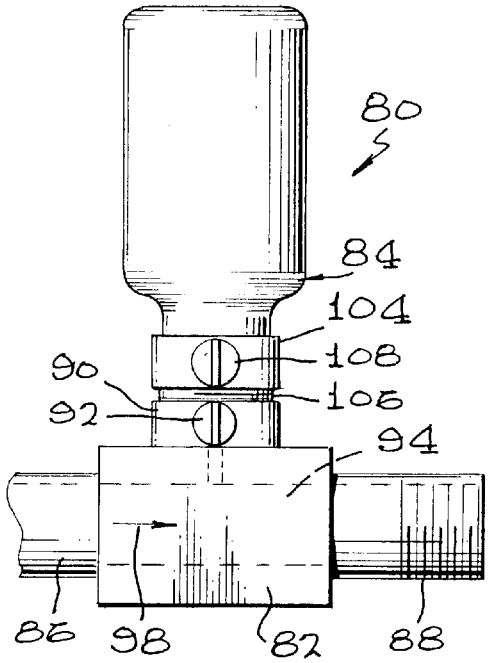
FIG. 5
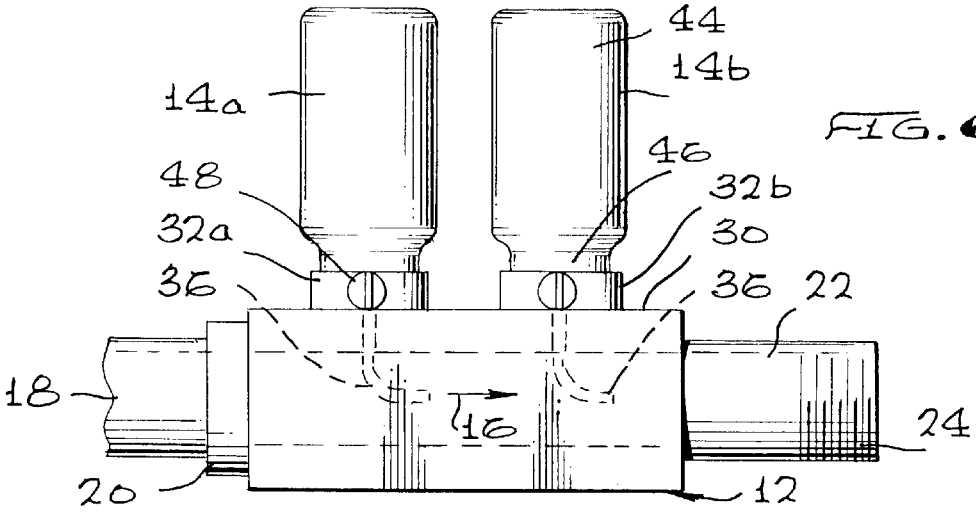
FIG. 6

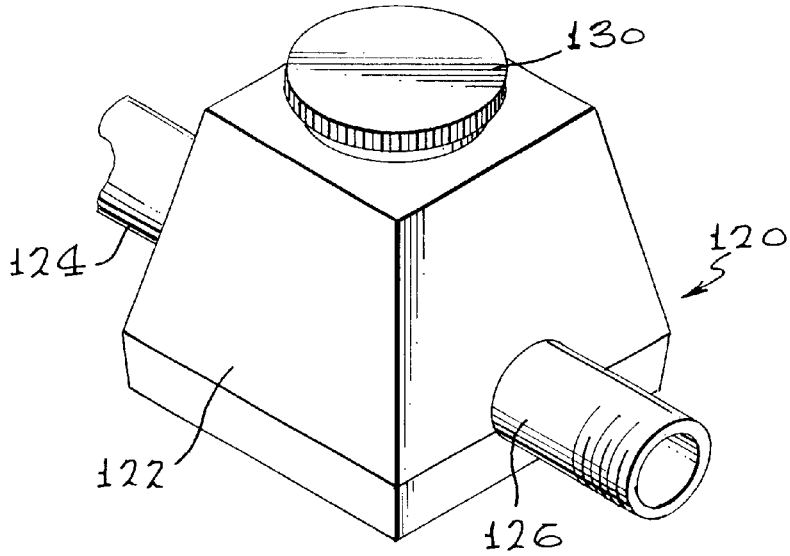
FIG. 7
FIG. 8
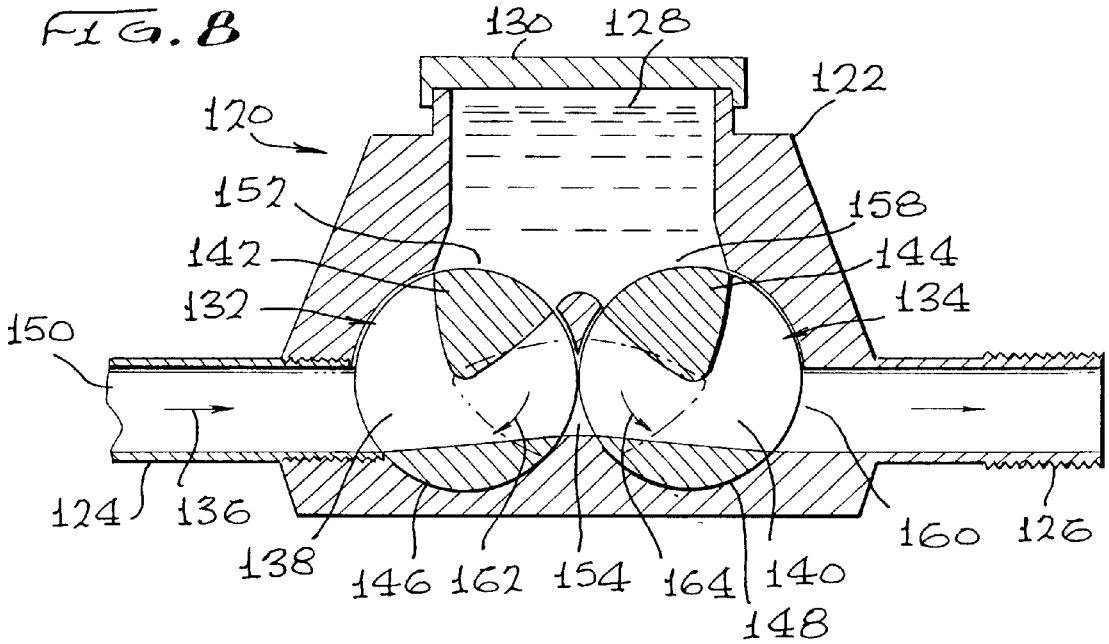
FIG. 9
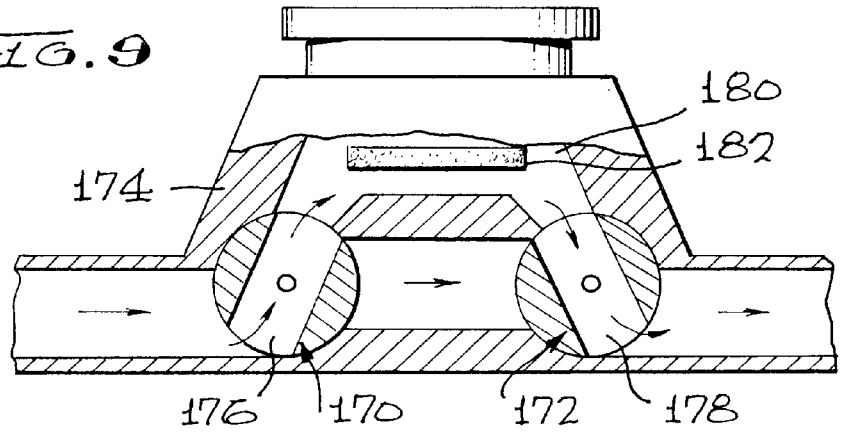

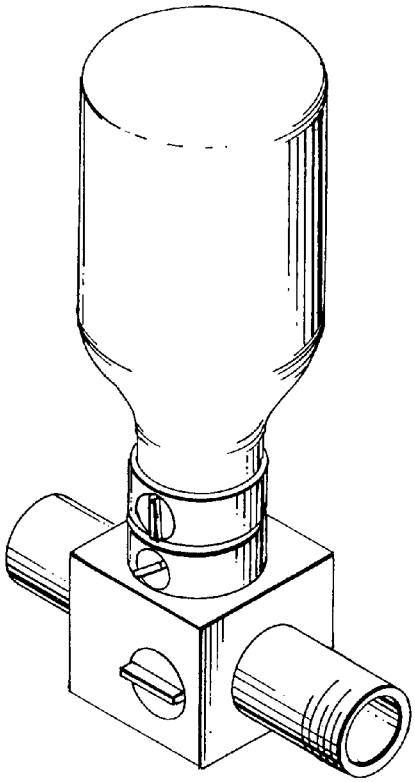
FIG. 15
FIG. 16
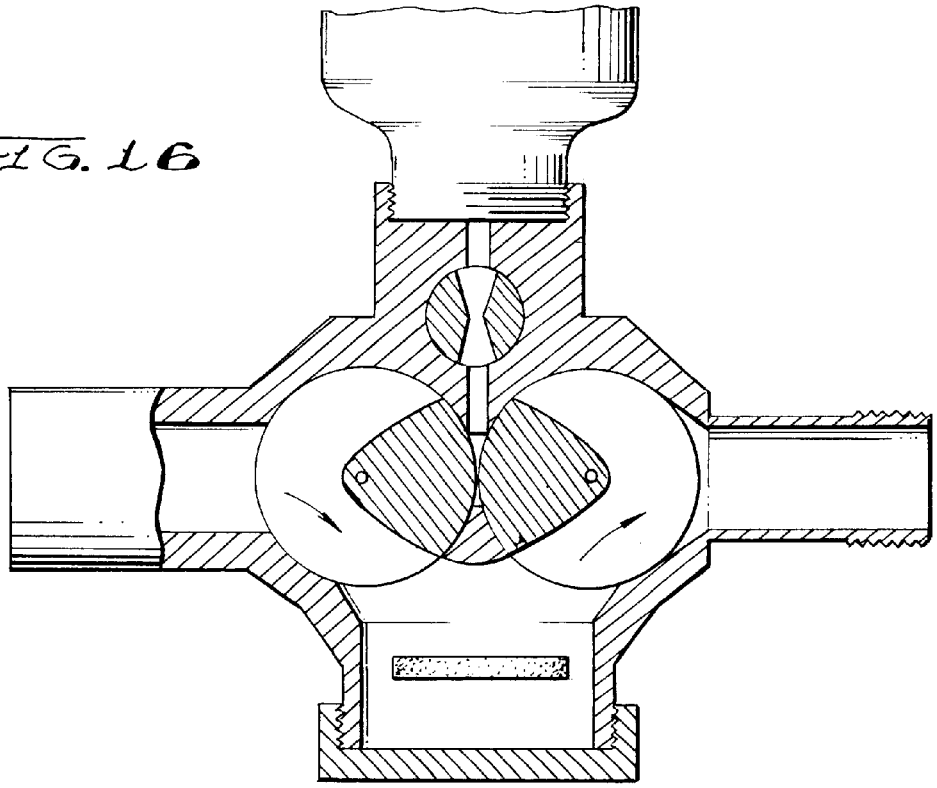

DISPENSER TO LIQUID STREAM

FIELD AND BACKGROUND OF THE INVENTION

This invention relates to dispensers to a liquid stream, and particularly a method and apparatus for dispensing additive liquid or dissolved materials into a stream of water. While the method and apparatus of the invention have many applications, a preferred application is in a domestic setting whereby additive in the form of liquid or dissolved particles, such as soap, conditioner, creams, body oils, herbs or other materials are introduced into a stream of flowing water which discharges through a shower head or faucet.

It is often desirable to mix with a stream of water liquids or dissolved particulate matter in order to benefit from the combination or mixture produced by the liquid and the water. This may be to advantage when, for example, a person is showering, and creams or conditioners are desired to enhance skin care, hair care etc. By introducing a steady and consistent amount of liquid or dissolved particulate matter into the water stream, an even and consistent application may be achieved much more readily than if the liquid is used in concentrated form and applied by the hands.

The invention is therefore directed to a method and apparatus for introducing an additive in the form of liquid or dissolved particulate matter into a water stream to facilitate easy and consistent application of desired products to the body.

SUMMARY OF THE INVENTION

The dispenser to liquid stream device of the invention comprises a body or housing which is preferably placed in line of the liquid stream, the housing including a pathway for the liquid and means whereby additive liquid or dissolved particulate matter may be introduced into the stream. The device may further comprise means for receiving a reservoir, receptacle or other device which contains an additive liquid which is introduced into the water stream.

In the case of a typical domestic shower, the housing may be placed between the water outlet pipe and the shower head. Thus, in mounting the dispenser of the invention, the shower head would be removed from the water pipe by unscrewing it, and placing the housing, which has appropriate threaded ends, between the outlet pipe and the shower head respectively, so as to intercept these two components.

The dispenser device of the invention preferably includes valve means whereby the liquid or solid particulate matter being introduced into the water stream can be shut off, so that these components will only enter the water stream at the desired times, by operating opening and closing means on the housing.

As mentioned, the invention may dispense liquids or dissolved particulate matter into the water stream. Liquids may include lotions, conditioners, soap, shampoo, body oils, herbs or other materials which are contained in a receptacle or reservoir and which may be releasably attachable to the housing. The receptacles may be self-sealing when removed from the housing, so that different receptacles, which may contain different substances, are located on the housing for introduction into the water stream. In another form, the housing, or an attachment to the housing, may contain a solid tablet which dissolves as water flows over and around it. The dissolved portion of the tablet would enter the water stream, and pass through the shower head so as to be available for use at the desired times.

In another form, the housing may be adapted to contain or receive a plurality of reservoirs or containers, each holding a different material, each of which can be selectively activated so that the contents thereof will enter the water stream when required.

In yet another embodiment, the dispenser device of the invention may be constructed so that metered or measured amounts of additive liquid are dispensed upon activation, dispensing the measured amount. No further action would be required by the user to switch off the valve. In such an embodiment, it may be possible to select the amount which will be dispensed, according to the nature and requirements of the user.

According to one aspect of the invention, there is provided a dispenser for introducing additive into a liquid stream, the dispenser comprising a housing unit having a flow-through passage forming a pathway for the liquid stream; seating means on the housing for receiving a receptacle, the seating means including a reservoir for holding the additive; a conduit extending between the seating means and the flow-through passage through which the additive can flow; and valve means for selectively controlling the flow of the additive in the conduit. Conveniently, the additive is supplied under pressure.

The valve may be spring-loaded so as to move from the open position to the closed position after a predetermined time. Further, the flow-through opening may be flared so as to maintain the valve in the open position for a longer period as it moves toward the closed position.

An opening pin on the seating means may be provided for penetrating a sealed membrane closing the receptacle. Preferably, the receptacle comprises a main body portion, and a neck portion having an opening therein, and a valve controlled cap member for opening and closing the opening.

According to another aspect of the invention, there is provided a dispenser for introducing additive into a liquid stream, the dispenser comprising: a housing unit having a water inlet, a flow-through passage, and a water outlet forming a first pathway for the liquid stream; a reservoir for containing the additive, the water inlet, reservoir and water outlet forming a second pathway for the liquid stream; and a valve mechanism movable between a first position whereby the liquid stream flows through the first pathway and a second position whereby the liquid stream flows through the second pathway and additive is mixed into the liquid stream.

The valve mechanism may comprise a pair of coordinated cylindrical valve members, each valve member having a closure segment and a flow-through conduit, the flow-through conduits of the valve members being in communication with each other when the valve mechanism is in the first position, with the closure segments of the valve blocking passage to the reservoir, and wherein the flow-through conduits of each valve are in communication with the reservoir and the closure segments adjacent each other when the valve mechanism is in the second position.

The reservoir may contain a solid additive which dissolves in the liquid stream. In such case, the reservoir incorporates a mesh filter upon which the solid additive is mounted for limiting movement of the solid additive within the reservoir.

In yet a further aspect of the invention, there is provided a dispenser for introducing additive into a liquid stream, the dispenser comprising: a housing having a flow-through passage forming a pathway for the liquid stream; a source of additive associated with the housing unit for supplying additive thereto; a load chamber in or adjacent the housing unit for receiving and holding a selected amount of additive from the source of additive; a conduit extending from the load chamber to the flow-through passage through which additive is delivered to the flow-through passage; means for dispensing additive from the load chamber to the flow-through passage; and control means for controlling the dispensing means.

Preferably, the load chamber has an entry port for receiving additive from the source of additive and an exit port for dispensing additive from the load chamber to the flow-through passage, a first one-way valve located at the entry port for permitting flow of additive from the source of additive to the load chamber only, and a second one-way valve at the exit port for permitting the flow of additive from the load chamber to the flow-through passage only.

The means for dispensing additive from the load chamber may comprise a piston movable within the load chamber, the piston being movable between a first load chamber empty position and second load chamber full position, wherein movement of the piston from the first position to the second position causes the load chamber to fill with additive provided from the additive source, and movement of the piston from the second to the first position dispenses additive from the load chamber to the flow-through passage.

Preferably, a piston rod is attached at one end to the piston, and extends therefrom through the load chamber and to the outside of the housing, the piston rod outside the housing being connected to an operating lever which forms the control means. A locking mechanism may be provided for locking the operating lever when the piston is located at a desired position within the load chamber.

BRIEF DESCRIPTION OF THE DRAWINGS

FIG. 1 is a diagrammatic cross-section showing a first embodiment of a dispensing device of the invention;

FIG. 2 is a side view of a second embodiment of the dispensing device of the invention;

FIG. 3 is a cross-section through the dispensing device shown in FIG. 2 of the drawings;

FIG. 4 is a perspective view of a third embodiment of a dispensing device of the invention;

FIG. 5 shows a cross-section through the dispensing device shown in FIG. 4 of the drawings;

FIG. 6 shows a fourth embodiment of a dispensing device of the invention comprising a plurality of liquid dispensers or containers;

FIG. 7 is a perspective view of a fifth embodiment of the dispensing device of the invention;

FIG. 8 is a cross-section through the dispensing device illustrated in FIG. 7 of the drawings, illustrating the operation thereof;

FIG. 9 shows a variation of the dispensing device as illustrated in FIGS. 7 and 8 of the drawings;

FIG. 15 is a perspective view of a seventh embodiment of the dispensing device of the invention;

FIG. 16 is a cross-section through the dispensing device of the invention shown in FIG. 15.

DETAILED DESCRIPTION OF THE PREFERRED EMBODIMENTS

Figure 10:
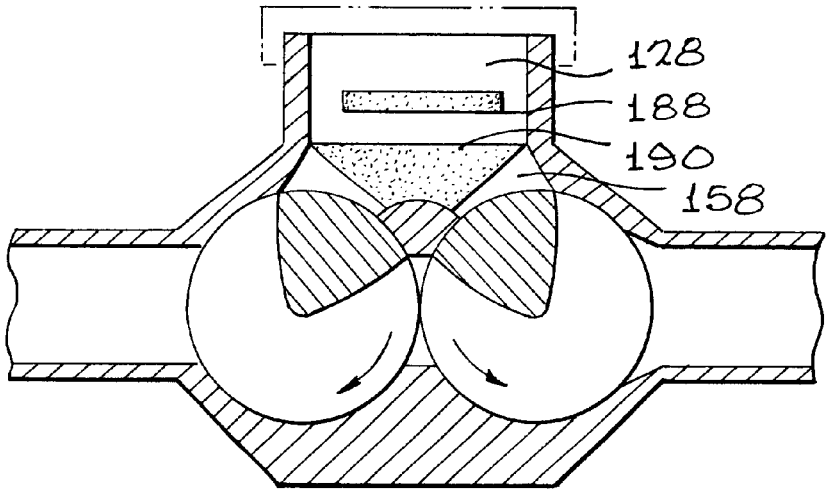
FIG. 10 illustrates yet another variation of the dispensing device shown in FIGS. 7 and 8 of the drawings.

Reference is now made to the accompanying drawings, which show a selection of various embodiments of the invention whereby additive in the form of liquid or dissolved particles may be introduced into a water stream. As will be noted, a large number of variations are possible, but common to all configurations of the invention is the provision of a housing which is located so as to be within the pathway of a stream of water, and valve means whereby liquids may be selectively introduced into the stream when desired.

Reference is now made to FIG. 1 of the drawings which shows a first embodiment of a dispenser 10 of the invention. The dispenser 10 comprises an in-line housing 12, and a container or receptacle 14 in which is located a liquid, such as soap, shampoo, body oil or the like, which may be selectively introduced in measured quantities to a water stream, identified by reference numeral 16, flowing through the housing 12. In one embodiment, the liquid is housed and introduced under pressure.

The housing 12 is threadedly connected in conventional manner to an outlet water pipe 18, the pipe 18 being connected to a source of water. Water flow in the pipe 18 is controlled by a tap, faucet or other valve, whereby water is delivered to the pipe 18, preferably as a mixture of hot and cold water at a desired temperature. The water pipe 18 threadedly engages with a connector portion 20 at one side of the housing.

The housing 12 further comprises an outlet pipe 22 on the side thereof opposite to the connector portion 20. The outlet pipe 22 has a male threaded section 24, to which a shower head, shown in phantom and identified by reference numeral 26, can be connected. The housing 12 includes a conduit 28, extending from the connector portion 20 to the outlet pipe 22. The conduit 28 facilitates the linear flow of water from the water pipe 18 through the housing 12, and out through the outlet pipe 22 to the shower head 26.

The housing 12 has an upper surface 30, and a seating 32 is constructed into the upper surface 30 so as to receive the receptacle 14, as will be described more fully below. Within the seating 32, there is an opening 34, and a tube 36 having a passage or channel is positioned so as to extend from the opening 34 to the conduit 28, thereby facilitating delivery of the contents of the receptacle into the water stream 16 flowing through the housing 12. The tube 36 is an open-ended one, having a vertical component 38 and a substantially horizontal component 40. The horizontal component 40 is more or less parallel to the water stream 16 flowing through the housing, and, in practice, the flowing water stream will, to some extent, create a vacuum effect about the opening 42 in the horizontal component 40 of the tube 36.

The receptacle 14 comprises a main body portion 44, and a neck portion 46. Prior to installation of the receptacle 14 on the housing 12, the open end of the neck portion 46 is sealed with a cap, membrane or other appropriate covering so as to prevent leakage of the contents of the receptacle. Moreover, in one embodiment, the contents of the receptacle 14 may be pressurized to facilitate movement thereof from the receptacle 14 into the water stream 16.

It will be noted that an on/off valve 48 is located or is associated with the tube 36, so that manual operation of the valve between the on and off position either facilitates flow of the contents of the receptacle through the tube 36, or closes the tube to prevent such flow. Only when it is desired that the contents of the receptacle 14 be introduced into the water stream will the valve 48 be activated to permit such flow.

The operation of the dispenser 10 shown in FIG. 1 is fairly straightforward. In use, a receptacle 14 is placed, after removal of the cap or membrane, within the seating 32 and may threadedly engage and seal with the seating in order to ensure a stable connection between the receptacle and the housing. The receptacle 14 is in the inverted position when mounted on the housing, so that the contents thereof may flow to the seating, either under internal pressure within the receptacle, or by the simple force of gravity. When the valve 48 is closed, the contents of the receptacle 14 will not flow. However, upon opening of the valve 48, the contents will flow through the opening 34, into the tube 36, and eventually exit the tube through opening 42 into the water stream 16. The contents will be agitated and mixed within the water stream, eventually passing to the outlet pipe 22, and through the shower head 26 to the user.

Reference is now made to FIGS. 2 and 3 of the drawings, which show a further embodiment of the dispenser of the invention. To the extent that components and elements of the dispenser 50, shown in FIGS. 2 and 3, are the same as those shown in FIG. 1, the same reference numerals have been used. FIG. 2 essentially shows the housing 12, including the seating 32 on the upper surface 30 thereof, with a receptacle having a main body portion 44 and a neck portion 46 mounted in an inverted position on the seating 32. As will be seen more clearly in FIG. 3, the water stream 16 flows through the water pipe 18, housing 12, to the outlet pipe 22 before entering a shower head, not shown.

As will be clearly seen in FIG. 3 of the drawings, the open end of the receptacle 14 is sealed by a membrane 52, and the membrane is ruptured or pierced by a needle 54 mounted within the seating 32. The seating 32 is comprised of side wall 56, having an internal thread 58, the internal thread 58 engaging an external thread 60 on the neck portion 46 of the receptacle 14. The needle 54 is an upwardly projecting sharp object, mounted on the base 62 of the seating 32, and pierces the membrane 52 as the receptacle 14 is mounted into and is received within the seating 32. The advantage of the membrane 52, pierced or ruptured only upon insertion of the receptacle 14 within the seating 32, is that it facilitates the insertion of a receptacle, the contents of which are under pressure, without allowing the pressure to be dissipated by opening the receptacle prior to location within the seating.

A valve 64 is located within the housing 12, the operation of which permits the flow of the contents of the receptacle 14 into the water stream 16. The valve 64 is spring-loaded, such that activation thereof opens the valve for a predetermined period of time, such as ten seconds, after which time the valve will automatically move into a closed position and prevent further flow of the contents of the receptacle into the water stream 16.

The valve 64 is of cylindrical shape, and includes a channel 66. The housing has located therein a port 68 such that when the valve 64 is in the open position, the channel 66 provides a line of communication between the seating 32 and the water stream 16. In the open position, the contents of the receptacle thus pass from the receptacle 14, through the membrane 52, and thereafter flow into the channel 66, finally exiting through the port 68 into the water stream 16. In FIG. 3 of the drawings, the valve 64 is shown in the open position. It will, of course, be appreciated that upon further rotation of the cylindrical valve 64, the line of communication between the seating 32 and the port 68 will be interrupted, thereby essentially closing the valve and preventing the flow of the contents of the receptacle 14.

When the valve 64 shown in FIG. 3 is moved into the open position, as illustrated, the contents will begin to flow into the water stream 16. Since the valve is spring-loaded, the action of the spring will commence to rotate the valve in a clock-wise direction in FIG. 3. The channel 66 has a flared or enlarged section 70 so that the initial rotation of the valve 64 will not result in the closure thereof. When the valve wall end 72 reaches the port 68, the last contents of the receptacle will flow through the port, but further rotation of the valve 64 will result in the valve wall end 72 covering the port 68, terminating flow of the contents. It will, of course, be appreciated that the amount of time that the valve remains open can, to an extent, be controlled by determining the size of the flared section 70. A smaller flared section 70 will thus produce a shorter time flow, while a larger flared section 70 will produce a longer time flow. The upper end 74 of the channel 66 remains open during all of its rotation, since it is not sealed off by the housing 12. This is because the upper end 74 is located above the base 62 of the seating 32, and, to all intents and purposes, is exposed to the flowing contents of the receptacle 14.

FIGS. 4 and 5 of the drawings show a third embodiment of the dispensing apparatus of the invention. With reference to FIG. 4, there is shown a dispenser 80, comprising a housing unit 82 and a receptacle 84. The housing unit 82 includes a connector 86 attachable to a pipe connected to a water source, and an outlet pipe 88 having threaded end 90 to which may be attached, for example, a shower head (not shown). On the upper surface 89 of the housing unit 82, there is located a seating unit 90, the seating unit 90 including a valve 92 through which contents from the receptacle 84 may selectively flow into the housing unit 82, and particularly the conduit 94 (see FIG. 5) in the housing unit 82 between the connector 86 and the outlet pipe 88. The valve 92 includes a handle 96 by means of which it can be turned so that the valve 92 will either be opened and contents can flow into the housing unit, or closed, to prevent further flow of the contents. The valve 92 in the embodiment shown in FIG. 4 may be of a fairly straightforward type, such as that shown in FIG. 1 of the drawings, or it may be a spring or a spring-loaded type, for example, similar to that shown in FIG. 3 of the drawings. In either event, the valve 92 has the general and overall function of shutting off or permitting flow of the contents from the receptacle 84 to the conduit 94, so that the contents can enter the water stream 98 flowing through the conduit.

The receptacle 84 has a main body portion 100 tapering to a narrow neck portion 102. The receptacle 84 has an open end at the neck portion 102, to which is attached or sealed a cap 104. The cap 104 includes an extension portion 106, best seen in FIG. 5, the extension portion preferably having an external thread which is received within the seating unit 90 in a similar manner to that already described with reference to FIGS. 1 to 3 of the drawings. The extension portion 106 is accommodated within the seating unit 90, such that the contents of the receptacle 84 are permitted, under circumstances to be described, to flow into the seating unit, and, thereafter, depending on the position of the valve 92, to either hold the contents in the seating unit when the valve is closed, or to permit flow thereof through the valve 92 and into the water stream 98.

The cap 104 includes the extension portion 106 which has preferably incorporated thereon an external thread, the external thread of the extension portion being received within the seating unit 90. With the receptacle 84 inverted and threadedly engaged and located within the seating unit 90, the flow of contents from the receptacle into water stream 98 can be controlled by manipulation and operation of the receptacle valve 108 and the valve 92. In general, once the receptacle 84 has been mounted within the seating unit 90, the receptacle valve 108 will be open so that the contents, preferably under pressure, within the receptacle 84 pass into the seating unit 90. When it is required that the contents be introduced into the water stream 98, the valve 92 is operated so as to open a line of communication extending from the seating unit 90 into the conduit 94, so that the contents of the receptacle 84 will flow through the cap 104, including through the valve 108 in the cap 104, and thereafter in to the seating unit 90, valve 92 (which may be spring loaded), and into the conduit 94.

One advantage of the arrangement shown in FIGS. 4 and 5 is that quick and simple removal and replacement of different receptacles 84 within the seating unit 90 can be achieved. Thus, if a mounted receptacle 84 contains, for example, shampoo or conditioner, and the user wishes to introduce skin lotion or body oils, for example, into the water stream, this can be easily be achieved by closing the receptacle valve 108, and unscrewing the extension portion 106 of the cap 104 from the seating unit 90. The cap 104, in coordination with the closed valve of the receptacle 108, will ensure that the contents of the receptacle do not leak, and remain hermetically sealed so that there will little or no contamination while the receptacle is no longer attached to the housing unit 82. When the first receptacle 84 is removed, another receptacle containing the different liquid required can be mounted on the seating unit 90, and the receptacle valve 108 of the replacement receptacle 84 opened. The contents of the replacement receptacle are now available for use, and, upon appropriate operation of the valve 92, such contents can be introduced into the conduit 94 through which the water stream 98 flows. Thus, the dual valve system, with one valve receptacle and another (conveniently spring loaded) on the housing unit, broadens the usefulness of the dispenser so that a significant number of receptacles, each containing different contents, can be used in a simple and efficient manner.

In FIG. 6 of the drawings, yet another embodiment of the dispenser of the invention is disclosed, wherein the housing has a plurality or multiple-seating unit, so that more than one receptacle can be mounted. This makes at least two types of liquid immediately available for use and introduction into the water stream without replacement of the receptacle.

The dispenser shown in FIG. 6 of the drawings is generally similar in construction and function to that illustrated in FIG. 1, and, therefore, reference numerals which have been used in FIG. 1 are shown in FIG. 6 to identify corresponding or equivalent components. Thus, an in-line housing 12 has a connector portion 20 which attaches to a water pipe 18, the water pipe 18 generally being connected to a water source, and through which the flow of water as well as the temperature thereof is controlled. The housing 12 further comprises an outlet pipe 22 having a male threaded section 24 which connects to, for example, a shower head (not shown), as described with reference to FIG. 1. The upper surface 30 of the housing comprises a pair of seating units 32*a* and 32*b*. Each of the seating units has a valve 48 whereby flow of liquid content from receptacles 14*a* or 14*b* can be controlled and permitted to enter the water stream 16 through tube 36. Each of the receptacles 14*a* and 14*b* includes the main body portion 44 and neck portion 46, and the receptacle is mounted by inversion thereof and screwing a threaded portion on the neck 46 into the seating 32*a* or 32*b*. Once inverted, the contents of each receptacle 14*a* and 14*b* flow into the seating, where they remain when valve 48 is closed, but, upon opening of the valve 48 flow, either by the pressurization of the receptacles or by gravity alone, into tubes 36, which dispense the contents into the water stream 16.

With the particular embodiment shown in FIG. 6, the receptacles 14*a* and 14*b* are simple disposed of when complete, or, in another embodiment, may be of a type shown in FIG. 4 of the drawings, so that each receptacle can be sealed by a receptacle valve, removed from the housing, and replaced when needed again.

In FIGS. 7 and 8 of the drawings, a further embodiment of the invention is shown, in this case illustrating a dispenser which has valves which can be adjusted to alter the path of the water stream. One water stream path would be substantially linear passing through the dispenser without mixing therein of any liquid or dissolved particulate matter being added to the stream. However, upon appropriate activation of the valves, to be described, the water stream path is diverted through a receptacle or reservoir containing the liquid or hard tablet desired to be added, and the water flow will continue to be diverted until the valves are reset. In FIG. 7 of the drawings, a dispenser 120 comprises a housing 122 having a connector 124 at one end thereof which is adapted to fasten to a pipe which is connected to a water source, in similar manner to those previously described. At its other end, the housing has an outlet pipe 126 through which the water stream, or the water stream mixed with the dispensed liquid, flows either to a tap, shower head or other device.

FIG. 8 shows a cross-section through the dispenser 120 of FIG. 7, illustrating the internal mechanism by means of which the water stream is diverted to pass over and collect a liquid introduced thereto, or to flow over a tablet. FIG. 8 also shows a reservoir 128 within the housing 122, the reservoir 128 being accessible upon removal of a cap 130, which threadedly engages the housing 122. The cap can be removed to introduce the appropriate liquid or dissolving solid tablet into the reservoir 128, and thereafter be replaced to seal off the reservoir and prevent further contamination.

The housing 122 includes a pair of cooperative valves 132 and 134 which, depending on their position, allow the water stream, identified by reference numeral 136 to either pass directly through the housing without accessing the reservoir 128 and the content thereof, or, upon appropriate resetting of the valves 132 and 134, alter the path of the water stream so as to pass through the reservoir 128. Each valve 132 and 134 is of cylindrical shape, with the valve 132 having a flow-through conduit 138, and the valve 134 having a flow-through conduit 140. Further, the valve 132 has a closure segment 142, while valve 134 has closure segment 144. Depending upon the position of each of the closure segments 142 and 144, as will be described below, the water stream 136 will either flow linearly through the housing, or will be directed to the reservoir section 128 for mixing with a liquid to be introduced.

The valve 132 is located within a valve chamber 146 in the housing 132, while the valve 134 is located within valve chamber 148, also within the housing 122 and adjacent to and downstream of the chamber 146. The chamber 146 has a water entry opening 150, a reservoir opening 152, and an opening 154 leading into the chamber 148. The chamber 148 shares the opening 154 with the chamber 146, and further comprises a reservoir opening 158, and water exit opening 160.

The relative position the valves 132 and 134, as well as the position of the closures segments 142 and 144 will determine the flow path of the water stream flowing through the housing 122.

It will be noted that the valves 132 and 134 are linked to each other by engaged gears, so that operation or rotation of one of the valves results in corresponding movement of the other. In one embodiment, therefore, rotation of valve 132 in a clockwise direction will result in the rotation of valve 134 in a counter-clockwise direction by the same distance.

In the drawing shown in FIG. 8, the valves 132 and 134 are shown in the position where the closure segments 142 and 144 block the reservoir openings 152 and 158 respectively. Therefore, water entering the connector 124 will pass through the water entry opening 150, proceed through the flow through conduit 138 and through opening 154 which joins the chambers 146 and 148. Water thereafter flows through conduit 140, through the water exit opening 160, and outwardly through the outlet pipe 126. In this arrangement, the water stream passes directly and substantially linearly through the housing 122, and does not access or mix with any contents of the reservoir 128.

When the user desires that the water exiting the outlet pipe 126 be mixed with quantities of liquid content or solid tablet contained in the reservoir 128, a lever is activated, and the valve 132 is turned clockwise in the direction indicated by the arrow 162. Since valve 132 is integrated with the valve 134, the valve 134 will turn in a counter-clockwise direction, as indicated by arrow 164. Rotation of the valves 132 and 134 moves the closure segments 142 and 144, so that both of these closure segments are facing each other, and essentially block the opening 154 between the chambers 146 and 148. The repositioning of the valves 132 and 134, and the positioning of the closure segments 142 and 144 is illustrated in phantom lines in FIG. 8 to show their new position.

With the closure segments 142 and 144 blocking off opening 154, the direction or pathway of the water stream is now altered. Thus, water entering the connector 124 passes through the water entry opening 150, through the flow-through conduit 138, through reservoir opening 152, and into the reservoir 128. Thereafter, the water passes through reservoir opening 158, through flow-through conduit 140, passing through the water exit opening 160, and eventually flowing from the housing 122 through the outlet pipe 126.

As the water passes through the reservoir 128, it is allowed to mix with liquid or solid contents thereof, and at least a part thereof will flow out as a water/additive mixture. The precise nature of contents in the reservoir 128, and whether liquid or solid which is dissolved by the flow of the water passing through the reservoir 128, can be varied, and different embodiments of a dispenser 120 as illustrated in FIGS. 7 and 8 of the drawings may accordingly be provided. As will be discussed in a further embodiment below, the reservoir may contain a solid tablet or component which dissolves at a predetermined rate so that the dissolved particles exit the water stream through the outlet pipe 126. In another form, the reservoir 128 may contain or receive a receptacle with liquid contents, which dispenses its contents into the reservoir 128 for mixing with the water stream as it passes therethrough.

FIG. 9 of the drawings shows a slight variation of the dispenser described in FIGS. 7 and 8. The arrangement shown in FIG. 9 is similar to that shown in FIG. 8, and will therefore not be described in great detail. In FIG. 9, valves 170 and 172 are provided, but are not adjacent to each other, being separated and located at different ends of housing 174. However, the valves work so as to coordinate with each other, with valve 170 including flow-through conduit 176 and valve 172 having flow-through conduit 178. Depending on the position of each of the flow-through conduits 176 and 178, the water stream will either pass directly through the housing without moving through reservoir 180, or the water will be diverted (as shown in FIG. 9) so that the water stream passes through reservoir 180 over a tablet 182 which dissolves in response to the water flow. The water then continues through flow-through conduit 178, and exits the housing.

FIG. 10 shows an embodiment very similar to that illustrated in FIG. 8, but further incorporates a tablet which constitutes the additive to the water stream desired by the user. In the embodiment shown in FIG. 10, the reservoir 128 has a filter mesh 190 which is completely accessible to the water, but only permits solid particulate matter of very small size to move therethrough. The filter mesh 190 will become necessary as the size of the tablet 188 diminishes by the dissolution thereof due to the action of the water. As the tablet 188 gets smaller, it may move into reservoir opening 158, causing a blockage. The filter mesh 190 therefore ensures that the tablet 188 is, and remains, remote from the operative valve structures, including openings, so as to facilitate the free flow of water through the housing.

Reference is now made to FIGS. 11 to 14 of the drawings, which show yet a further embodiment of the invention. In this embodiment, a mechanism is provided whereby measured or metered amounts of solution or additive can be introduced into the water flow path. Thus, when the dispenser of the invention described and illustrated in FIGS. 11 to 14 is activated, a preset quantity or volume of additive will flow into the water, and thereafter stop until the dispenser has been reloaded and released for further mixing.

Figure 11:
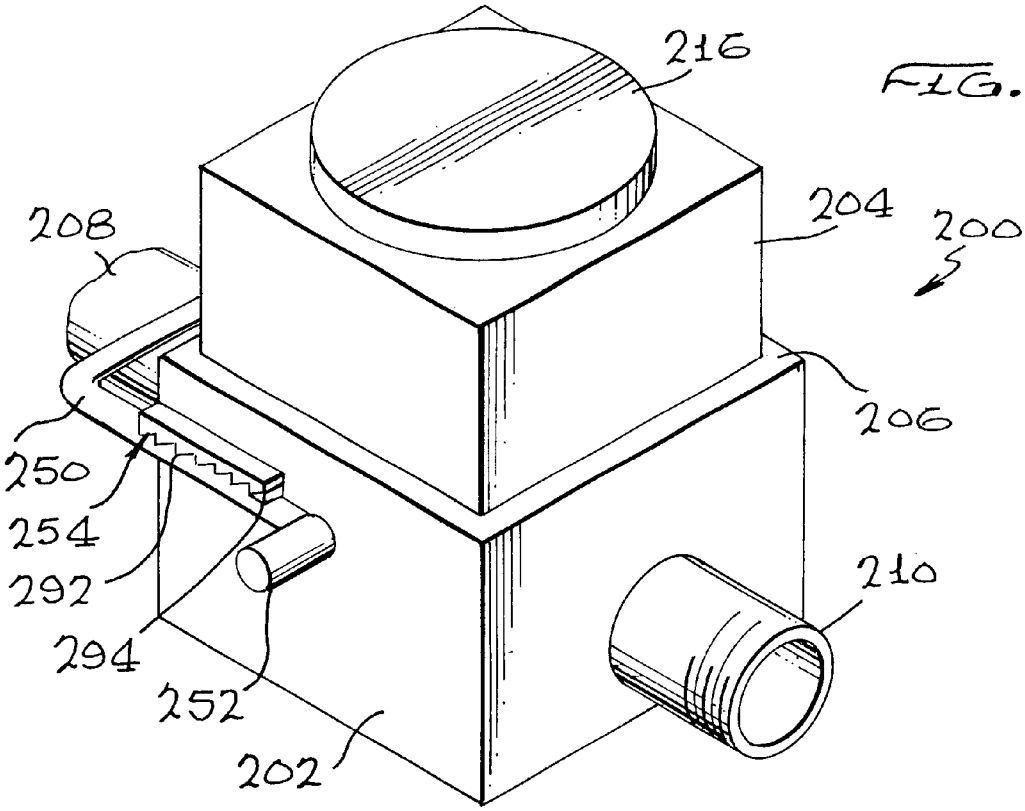
FIG. 11 is a perspective view of a sixth embodiment of a dispensing device of the invention.
Figure 12:
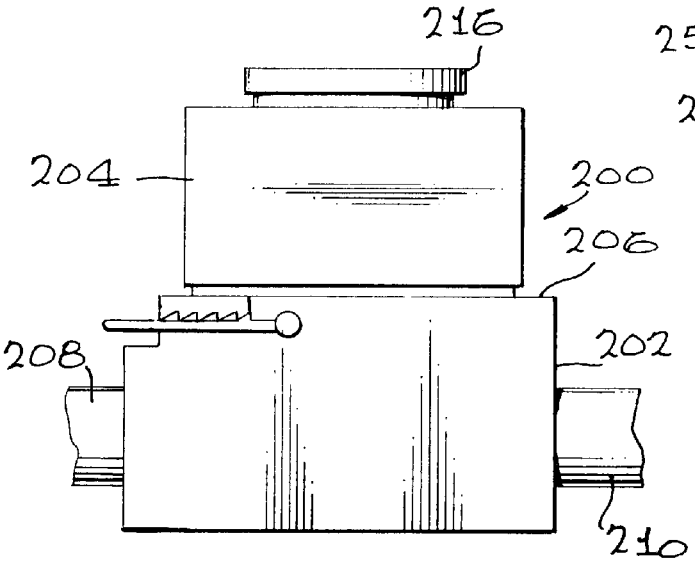
FIG. 12 is a side view of the dispensing device shown in FIG. 11 of the drawings.

FIG. 11 shows a perspective view of the dispenser 200, the dispenser 200 having a housing unit 202 and a reservoir 204 mounted on the upper surface 206 of the housing unit 202. The housing unit 202 includes a connector 208 which attaches to a water pipe connected to a source of water, as already described. At its other end, the housing includes a water exit pipe 210. The housing includes a flow-through conduit 212, seen in FIG. 13 of the drawings, and therefore provides a substantially linear pathway for the water stream extending from the connector 208, through the flow-through conduit 212, and out of the water exit pipe 210. The water is never diverted in this embodiment, and while additive or solution can be mixed with the water flowing through the flow-through conduit 212, as will be described, the pathway of the water stream remains unchanged.

The reservoir 204 may be of any suitable shape, and defines a tank 214 into which additive, solution or other liquid to be introduced into the water stream can be located. The reservoir 204 includes a screw-on cap 216, which provides access to the tank 214, and through which the solution is poured. The reservoir 204 has a base wall 218, in which is located an orifice 220 through which the contents can flow, as will be described. The orifice 220 is in communication with entry pipe 222, which is located within the housing unit 202.

The housing unit 202 includes a load chamber 224 into which solution is introduced, and is intermediary the tank 214 and the flow-through conduit 212. The load chamber 224 is preferably of cylindrical shape, and has an entry port 226 and an exit port 228. The entry port 226 is supplied by entry pipe 222 and an exit pipe 230 is provided whereby solution leaving the exit port 228 is directed from the load chamber 224 into the flow-through conduit 212. The entry port 226 is controlled by one-way valve 232 which permits the flow of solution from the entry pipe 222 into the load chamber 224, but prevents any solution from flowing from load chamber 224 back into the entry pipe 222. The exit port 228 is controlled by one-way valve 234 which permits flow of solution from the load chamber 224 into the exit pipe 230, but prohibits any liquid flow from the exit pipe 230 back into the load chamber 224.

A piston 236 is located within the load chamber 224, and a piston rod 238 is connected to piston 236. A back wall 240 of the load chamber has an aperture 242 therein through which the piston rod 238 is able to pass. A spring 244 is located about the piston rod 238, and exerts a force between the back wall 240 and the piston 236, thereby urging the piston 236 towards the front wall 248 of load chamber 224.

Figure 14:
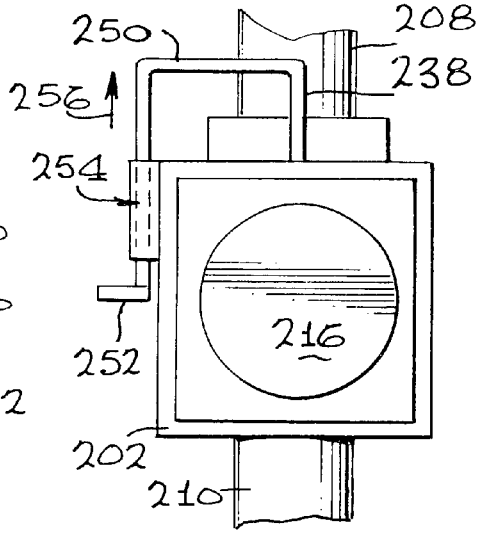
FIG. 14 is a top view of the dispensing device shown in FIGS. 11 to 13 of the drawings.
Figure 13:
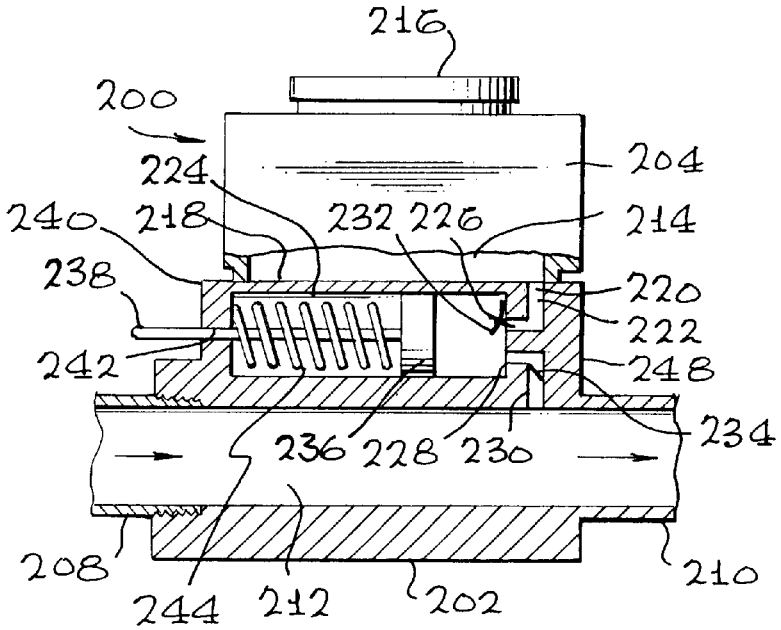
FIG. 13 is a cross-section through the dispensing device shown in FIGS. 11 and 12 of the drawings.

The piston rod 238 extends outwardly of the housing 202 through aperture 242, and continues as an operating lever 250 outside the housing 202. This operating lever 250 is best shown in FIGS. 11 and 14 of the drawings. The piston rod 238 and operating lever 250 form a U-shaped structure outside the housing, and the free end of the operating lever terminates in a handle 252. A locking mechanism 254 is located on the exterior of the housing so that the operating lever can be fixed in various positions. The locking mechanism 254 comprises a series of pointed projections 292 extending from the housing 202 and a stop member 294 on the operating lever 250 which engages a selected space 294 located between two projections 292. It will be appreciated that, depending upon the position of the piston 236 within the load chamber 224, the operating lever 250 and handle 252 will either be in a forward or rearward position relative to the housing.

In use, the handle 252 is pulled backwardly in the direction indicated by reference numeral 256, thereby pulling the operating lever 250 and piston 238 in a backwards direction. This results in the piston 236 moving towards the back wall 240 of the load chamber 224, at the same time loading the spring 244 between the back wall 240 and the piston 238. As the piston moves backward, a vacuum is created within the load chamber 224, which causes additive or solution to flow from the tank 214, through entry pipe 222 and into the front portion 290 of the load chamber 224 through the entry port 226. The one-way valve 232 will permit such flow. When the piston is at the desired position, at any point within the load chamber, right up to the back wall 240 thereof, the expanded front portion 290 of the load chamber will be filled with solution. The amount of solution in the load chamber will depend upon the extent to which the piston has been drawn towards the back wall 240. Of course, the load chamber 224 will be full when the piston is adjacent the back wall 240, and will have varying amounts of solution if the piston is in a position which has not quite reached the back wall 240. The user can select the desired position to determine the amount of solution that will enter the water stream and flow through conduit 212, thereby providing a metering or measuring mechanism for selecting the amount of solution desired. When the appropriate amount of solution desired has been selected, the handle 252 and operating lever 250 are manipulated so as to engage it with the locking mechanism 254, preventing further movement of the piston 238.

When it is desired that the solution in the load chamber 224 enter the water stream, the handle 252 is adjusted so as to release the operating lever 250 from the locking mechanism. At this point, the spring 244 will urge the piston 236 towards front wall 248, and solution will pass through exit port 228, past one-way valve 234 and into the exit pipe 230. The exit pipe 230 dispenses the solution into the water stream flowing through the flow-through conduit 212, providing the desired mix of additive with water.

At any point along the movement of the piston, the operating lever 250 can be locked against the locking mechanism 254 to prevent the dispensation of further liquid. Alternatively, if the mechanism is not locked, the action of the spring 244 on the piston 236 will dispense all of the contents of the load chamber 224 into the flow-through conduit 212. The load chamber 224 can thereafter simply be refilled by pulling back the operating lever 250, and fixing it with respect to the locking mechanism 254, at which point the dispenser 200 will be loaded with solution which can be dispensed into the water stream at the desired time.

FIGS. 15 and 16 show yet a further embodiment of the invention, although this embodiment constitutes, for most purposes, a combination of dispenser devices which are illustrated in FIG. 4 and FIG. 11 of the drawings. Therefore, this embodiment will not be described in any detail, except to indicate that the embodiment shown in FIGS. 15 and 16 comprises a housing to which is attached the liquid dispenser, as well as a chamber for accommodating a solid tablet. Thus, the housing comprises a seating upon which a container or receptacle is located, and both the seating as well as the receptacle are valve-controlled to control the flow of liquid or additive in the container into the stream. Furthermore, there is provided a chamber for the tablet, best shown in FIG. 16, as well as the cooperative valves shown in FIG. 16 by means of which the water flow may be diverted over the solid tablet so as to dissolve it and introduce particles thereof into the water stream. The cooperative valves are moved between a position closing off flow over the tablet, and a position permitting water flow over the tablet, and these valves are controlled by a knob on the exterior of the housing, best shown in FIG. 15.

Figure 17:
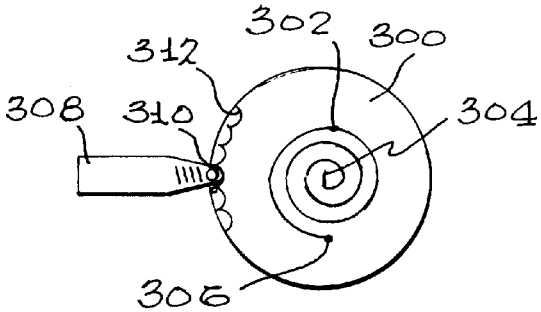
FIG. 17 is a specific aspect of the invention showing a spring-loading mechanism for a valve shown, for example, in FIG. 8 of the drawings.

Referring now to FIG. 17, there is shown a spring-loaded mechanism by means of which the cooperative valves of the type shown in FIGS. 8, 10 and 16 can be controlled. Using the spring-loaded mechanism, the cooperative valves can be forced closed, but at a slower pace, so that more liquid can be introduced into the water stream. In FIG. 17, there is shown a disc or plate 300, which may be directly and fixedly mounted onto a cooperative valve 132, for example, shown in FIG. 8. Alternatively, this disc 300 may be the valve itself. A tension spring 302 is fixed to the disc 300 at one end thereof 304. The other end 306 of the spring is fixed to a portion of the housing independent of the cooperating valve 132. When the valve 132 is tightened, by rotating it, or where, in effect, the valve is moved so as to allow the water stream through the housing so as to permit liquid or additive to be introduced therein, the spring 302 will tighten, and, when released, begin to return to its original position. As it moves, the spring will tend to move the valve 132 towards closing off access to the liquid additive. Eventually, the valve will close under urging from the spring 302, and the water stream will return to normal and flow directly through the housing. In this way, a measured quantity of liquid can be introduced, and the amount thereof can be varied depending upon the force and positioning of the spring 302.

In the embodiment shown in FIG. 17, the speed at which the valve is caused to close may be regulated by the location of a plunger 308. The plunger 308 has a pointed end 310 which engages in one of a series of scalloped cut-outs 312.

By rotating the disc 300, and engaging the plunger 308 in different cut-outs 312, the tension in the spring 302 can be tightened or relieved, to thereby quicken or reduce the amount of time taken until the spring returns the valve to the close-off position so that liquid additive can no longer be accessed.

From the various embodiments of the dispenser device of the invention described and illustrated herein, it will be appreciated that an effective and simple mechanism is provided whereby additives, whether liquid or dissolved particles, can be effectively introduced into a stream of water. The dispenser of the invention is flexible in permitting easy interchange of receptacles and additives so that the device is not confined. Moreover, at least one embodiment of the invention provides for metering or measuring the amount of additive to be dispensed, so that predetermined optimal amounts of the additive are introduced into the liquid stream.

While certain specific embodiments have been described above, the invention is not limited thereto, and variations within the scope of the description and claims may be provided.

We claim:

1. A dispenser for introducing additive into a liquid stream, the dispenser comprising:

a housing unit having a flow-through passage having an axis and forming a pathway for the liquid stream;

seating means on the housing for receiving a receptacle, the seating means including a reservoir for holding at least a portion of the additive;

a conduit extending between the seating means and the flow-through passage through which the additive can flow, the conduit comprising a first component extending from the seating means to the flow-through passage and second component located in the flow-through passage and formed at an angle to the first component, the second component having an axis which is substantially coextensive with the axis of the flow-through passage so that additive in the second component can flow substantially in parallel with liquid stream in the pathway; and valve means for selectively controlling the flow of the additive in the conduit.

2. A dispenser as claimed in claim 1 wherein the pathway for the liquid stream is substantially linear.

3. A dispenser as claimed in claim 1 wherein the seating means is located on an upper surface of the housing unit, the seating means being substantially cylindrical in shape and having an open end for sealingly engaging the receptacle.

4. A dispenser as claimed in claim 3 wherein the seating means comprises a threaded portion at its open end for threadedly engaging the receptacle.

5. A dispenser as claimed in claim 1 wherein the conduit comprises a pipe, the first component is a substantially vertical component which is attached to the seating means, and the second component is a substantially horizontal component located in the flow-through passage.

6. A dispenser as claimed in claim 5 wherein the valve comprises means for opening and closing the pipe.

7. A dispenser as claimed in claim 1 wherein the first component of the conduit comprises a channel in the housing extending between the seating means and the flow-through passage.

8. A dispenser as claimed in claim 7 wherein the valve is located within the channel, the valve having a flow-through opening movable between a first position wherein the channel is closed, and a second position wherein the channel is open.

9. A dispenser as claimed in claim 8 wherein the valve is spring-loaded so as to move from the open position to the closed position after a predetermined time.

10. A dispenser as claimed in claim 9 wherein the flow-through opening is flared so as to maintain the valve in the open position for a longer period as it moves toward the closed position.

11. A dispenser as claimed in claim 1 further comprising a receptacle mounted on the seating means.

12. A dispenser as claimed in claim 11 further comprising an opening pin on the seating means for penetrating a sealed membrane closing the receptacle.

13. A dispenser as claimed in claim 11 wherein the receptacle comprises a main body portion, and a neck portion having an opening therein, and a valve controlled cap member for opening and closing the opening.

14. A dispenser as claimed in claim 1 further comprising an opening pin on the seating means for penetrating a sealed membrane closing the receptacle.

15. A dispenser as claimed in claim 1 comprising a plurality of seating means, each seating means being capable of receiving a receptacle.

16. A dispenser as claimed in claim 1 wherein the additive is under pressure and introduced to the housing unit under pressure.

17. A dispenser for introducing additive into a liquid stream, the dispenser comprising;

a housing unit having a water inlet, a flow-through passage, and a water outlet forming a first pathway for the liquid stream;

a reservoir for containing the additive, the water inlet, reservoir and water outlet forming a second pathway for the liquid stream, wherein the additive in the reservoir is a solid additive which dissolves in the liquid stream and the reservoir incorporates a mesh filter upon which the solid additive is mounted for limiting movement of the solid additive within the reservoir; and a valve mechanism movable between a first position whereby the entire liquid stream flows through the first pathway and a second position whereby the entire liquid stream flows through the second pathway, and additive is mixed into the liquid stream when the liquid stream or a portion thereof flows through the reservoir.

18. A dispenser as claimed in claim 17 wherein in the valve mechanism comprises a pair of coordinated cylindrical valve members, each valve member having a closure segment and a flow-through conduit, the flow-through conduits of the valve members being in communication with each other when the valve mechanism is in the first position, with the closure segments of the valve blocking passage to the reservoir, and wherein the flow-through conduits of each valve are in communication with the reservoir and the closure segments adjacent each other when the valve mechanism is in the second position.

19. A dispenser as claimed in claim 18 wherein each of the valve members has gear teeth in contact with each other so that movement of one valve member causes corresponding movement of the other gear member.

20. A dispenser as claimed in claim 19 wherein the reservoir contains a liquid additive.

21. A dispenser for introducing additive into a liquid stream, the dispenser comprising:

a housing having a flow-through passage forming a pathway for the liquid stream;

a source of additive associated with the housing unit for supplying additive thereto;

a load chamber in or adjacent the housing unit for receiving and holding a selected amount of additive from the source of additive, the load chamber having an entry port for receiving additive from the source of additive and an exit port for dispensing additive from the load chamber to the flow-through passage, a first one-way valve located at the entry port for permitting flow of additive from the source of additive to the load chamber only, and a second one-way valve at the exit port for permitting the flow of additive from the load chamber to the flow-through passage only;

a conduit extending from the load chamber to the flow-through passage through which additive is delivered to the flow-through passage;

means for dispensing additive from the load chamber to the flow-through passage; and control means for controlling the dispensing means.

22. A dispenser as claimed in claim 21 wherein the source of additive comprises an additive tank mounted on the housing unit, a communication pipe being located between the tank and the load chamber.

23. A dispenser as claimed in claim 21 wherein the means for dispensing additive from the load chamber comprises a piston movable within the load chamber, the piston being movable between a first load chamber empty position and second load chamber full position, wherein movement of the piston from the first position to the second position causes the load chamber to fill with additive provided from the additive source, and movement of the piston from the second to the first position dispenses additive from the load chamber to the flow-through passage.

24. A dispenser as claimed in claim 23 further comprising a spring normally urging the piston from the second to the first position.

25. A dispenser as claimed in claim 23 further comprising a piston rod attached at one end to the piston, and extending therefrom through the load chamber and to the outside of the housing, the piston rod outside the housing being connected to an operating lever which forms the control means.

26. A dispenser as claimed in claim 25 further comprising a locking mechanism for locking the operating lever when the piston is located at a desired position within the load chamber.

* * * * *